US007178535B2

(12) United States Patent
Eder

(10) Patent No.: US 7,178,535 B2
(45) Date of Patent: Feb. 20, 2007

(54) UMBRELLA WITH IMPROVED HUB

(76) Inventor: Fred Eder, 4212 Gulf Breeze Pkwy., Gulf Breeze, FL (US) 32563

( * ) Notice: Subject to any disclaimer, the term of this patent is extended or adjusted under 35 U.S.C. 154(b) by 126 days.

(21) Appl. No.: 10/921,688

(22) Filed: Aug. 19, 2004

(65) Prior Publication Data

US 2006/0102215 A1 May 18, 2006

(51) Int. Cl.
*A45B 25/06* (2006.01)
*F16B 7/04* (2006.01)

(52) U.S. Cl. ..... 135/28; 135/30; 135/135; 403/218; 403/170

(58) Field of Classification Search ..... 135/98, 135/135, 147, 28–30, 38, 43; 403/218, 170–171
See application file for complete search history.

(56) References Cited

U.S. PATENT DOCUMENTS

| | | | | |
|---|---|---|---|---|
| 2,984,249 | A | 5/1961 | Sears et al. | |
| 4,368,749 | A * | 1/1983 | Lindler et al. | 135/15.1 |
| 4,627,210 | A * | 12/1986 | Beaulieu | 52/646 |
| 4,674,523 | A | 6/1987 | Glatz | |
| 4,941,499 | A * | 7/1990 | Pelsue et al. | 135/125 |
| 4,966,178 | A * | 10/1990 | Eichhorn | 135/123 |
| 5,069,572 | A * | 12/1991 | Niksic | 403/170 |
| 5,085,239 | A * | 2/1992 | Chin-Hung et al. | 135/25.33 |
| 5,086,797 | A | 2/1992 | Earnshaw et al. | |
| 5,193,566 | A | 3/1993 | Chen | |
| 5,247,956 | A | 9/1993 | Vincent | |
| 5,494,065 | A | 2/1996 | Kuo et al. | |
| 6,076,540 | A | 6/2000 | You | |
| 6,102,058 | A | 8/2000 | You | |
| 6,296,415 | B1 * | 10/2001 | Johnson et al. | 403/170 |
| 6,298,867 | B1 | 10/2001 | Chang | |
| 6,314,976 | B1 | 11/2001 | Clarke | |
| 6,386,214 | B1 | 5/2002 | Clarke | |
| 6,655,398 | B2 | 12/2003 | Huang | |
| 2003/0019512 | A1 | 1/2003 | You | |
| 2003/0159725 | A1 | 8/2003 | Chou et al. | |
| 2003/0159726 | A1 | 8/2003 | You | |
| 2003/0178050 | A1 | 9/2003 | Wu | |
| 2003/0188773 | A1 | 10/2003 | You | |

FOREIGN PATENT DOCUMENTS

| | | | |
|---|---|---|---|
| EP | 0897678 | * | 8/1999 |
| WO | WO97/49310 | | 12/1997 |

* cited by examiner

*Primary Examiner*—Winnie Yip
(74) *Attorney, Agent, or Firm*—William H. Hollimon

(57) ABSTRACT

An improved umbrella includes a durable hub including a number of spherical rotating joint knuckles captured in a hub body. The joint knuckles provide rotational movement of rib and spreader elements which support a flexible umbrella cover. The joint knuckles provide increased bearing surface area that increases ease of use and durability. The hub design enables identical hub bodies to be used for a spreader hub and a rib hub.

10 Claims, 4 Drawing Sheets

UMBRELLA WITH IMPROVED HUB

BACKGROUND OF THE INVENTION

The present invention pertains to collapsible umbrellas for personal use as are typically used for protection from the sun. In particular, the present invention is an umbrella including an improved hub design providing easy and durable operation for umbrellas of the larger sizes and weights.

Such umbrellas are generally known in the prior art. U.S. Pat. No. 5,193,566 to Chen; U.S. Pat. No. 5,247,956 to Vincent; U.S. Pat. No. 6,076,540 to You; U.S. Pat. No. 6,314,976 to Clarke; and U.S. Pat. No. 6,298,867 to Chang disclose various designs which attempt to resolve some of the weaknesses of the collapsible umbrella concept. Particularly, many umbrellas suffer from high weight which makes their manual operation difficult by the user. High weight is a problem directly, and indirectly as producing friction between the relatively moving parts during erection of the umbrella canopy. In addition, as devices often used outdoors in conditions introducing grit and moisture to the umbrella parts, umbrellas are susceptible to corrosion and wear which further hamper operation by users and produce a need for repair. Prior art umbrellas do not provide sufficiently smooth operation for manual operation by single person users, particularly in larger umbrellas. The Vincent patent illustrates one typical design where umbrella ribs and spreaders are pivotably attached at the upright pole by means of wires passing through holes in rib and spreader proximal ends, respectively. While the wires provide an axis of rotation for the moving ribs and spreaders, the rotational friction is inherently high in such a design. In addition, due to the small bearing area between the wire and the rib or spreader hole, high bearing forces produce a high level of wear and deterioration of the parts, increasing the problem. These events are accelerated by environment moisture and grit. In any umbrella design where the bearing area is small at the point of rotation of the ribs and spreaders, bearing and friction forces will likely be a source of problems for the user.

In addition, the design of prior art umbrellas do not provide for easy disassembly for maintenance or replacement of parts. What is needed is an improved umbrella hub design that provides for durable and low friction movement of the umbrella elements during opening and closing operations of the umbrella and provides for easy maintenance and repair.

SUMMARY OF THE INVENTION

The present invention is an improved umbrella and umbrella hub. The inventive umbrella hub incorporates a spherically shaped ball joint knuckle secured to the inner end of the umbrella frame ribs and spreaders. The joint knuckles are received and retained in spherical bearing surfaces to provide pivoting movement of the ribs and spreaders. The joint knuckles have a radial dimension larger than the cross-sectional dimension of the rib or spreader to provide increased bearing area and consequent decreased bearing stresses. This geometry increases durability and life and ease of use. These advantages of the instant inventive design are particularly appreciated in larger umbrellas having a cover extended diameter in the range of six to twenty feet.

The hub is preferably formed of a flange member and matching face plate that are joined to a sleeve for receiving an umbrella pole. The flange and face plate each include spherical depressions that, when the flange and face plate are joined, define the bearing surfaces retaining the joint knuckles. This configuration may be identically used for both a rib hub and spreader hub to simplify and reduce the cost of manufacture and assembly. In a rib hub, the joint knuckles include a projecting stop post that, through interference with the hub, functions as a rotational stop for the attached rib. The face plate of the preferred hub design is removable for easy maintenance or replacement of parts.

Additional elements and advantages of the invention are illustrated in the following description of preferred embodiments and the accompanying illustrations.

DESCRIPTION OF THE PREFERRED EMBODIMENTS

Figure 1:
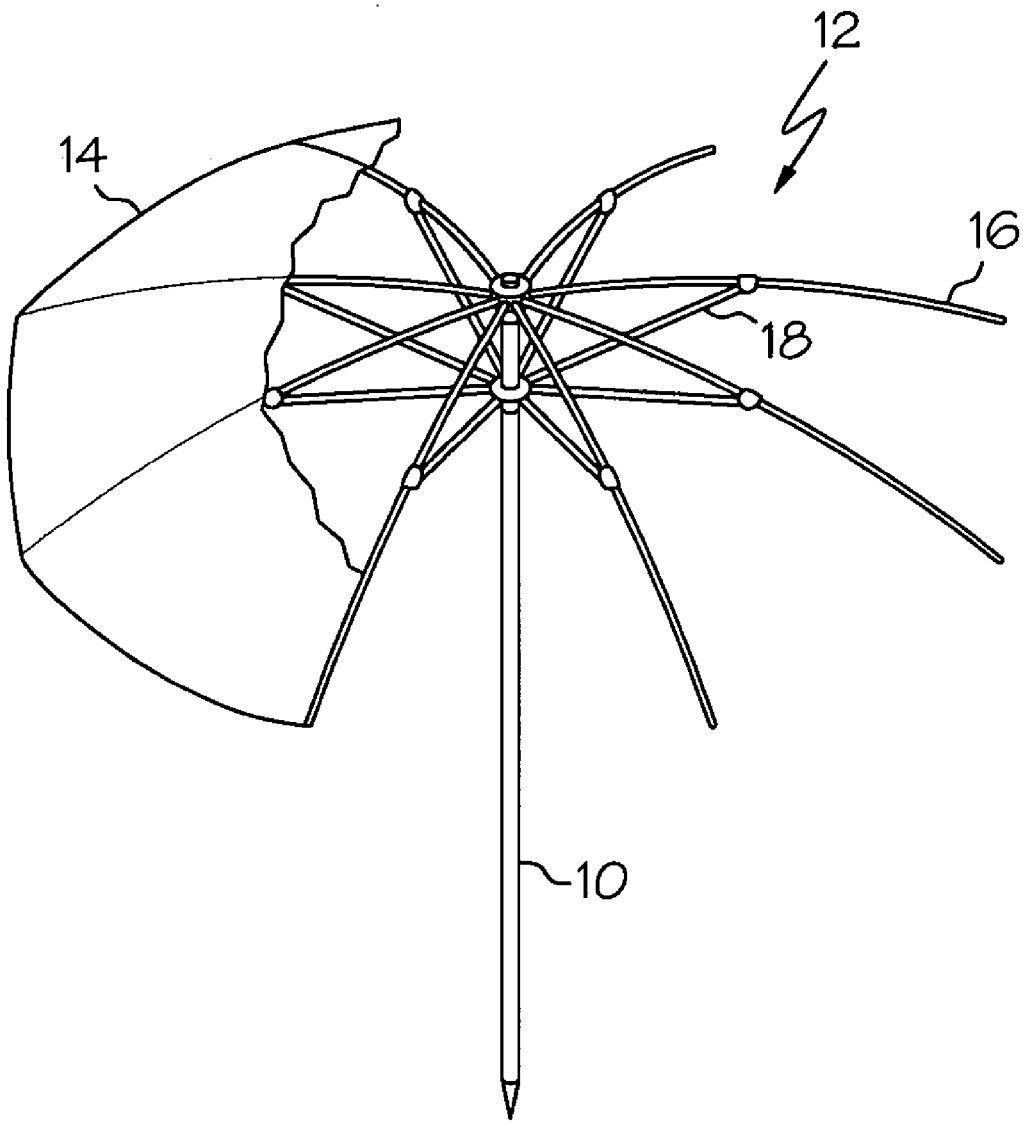
FIG. 1 is a perspective view of an umbrella according to the invention incorporating inventive hubs.

FIG. 1 is a perspective view of an umbrella according to the invention. The umbrella includes a center ridge pole 10 which is the main support and which may be, as in the prior art, pointed at its lower end for penetration into the ground. At the top of the ridge pole 10 is attached a collapsible framework 12 which supports a flexible cover 14 (shown partially cut away). The cover 14 may be formed of fabric, plastic, rubber-coated fabric, or similar materials known in the art for providing rain or sun protection. The general construction, cooperation, and operation of the framework 12 and the cover 14 are known in the art. While the embodiment shown in the figure has a framework 12 and cover 14 of overall generally circular geometry, other geometries such as square are also contemplated.

The framework 12 consists of, essentially, elongated and somewhat flexible ribs 16 and supporting spreaders 18. The ribs 16 are under, and attached to, the cover 14, and when fully expanded, stretch the cover 14 to its operational, open, configuration. The spreaders 18 are each pivotally attached at a distal end to a respective rib 16 at a point intermediate between the rib ends, and support the ribs 16 in its operational configurations.

Figure 2:
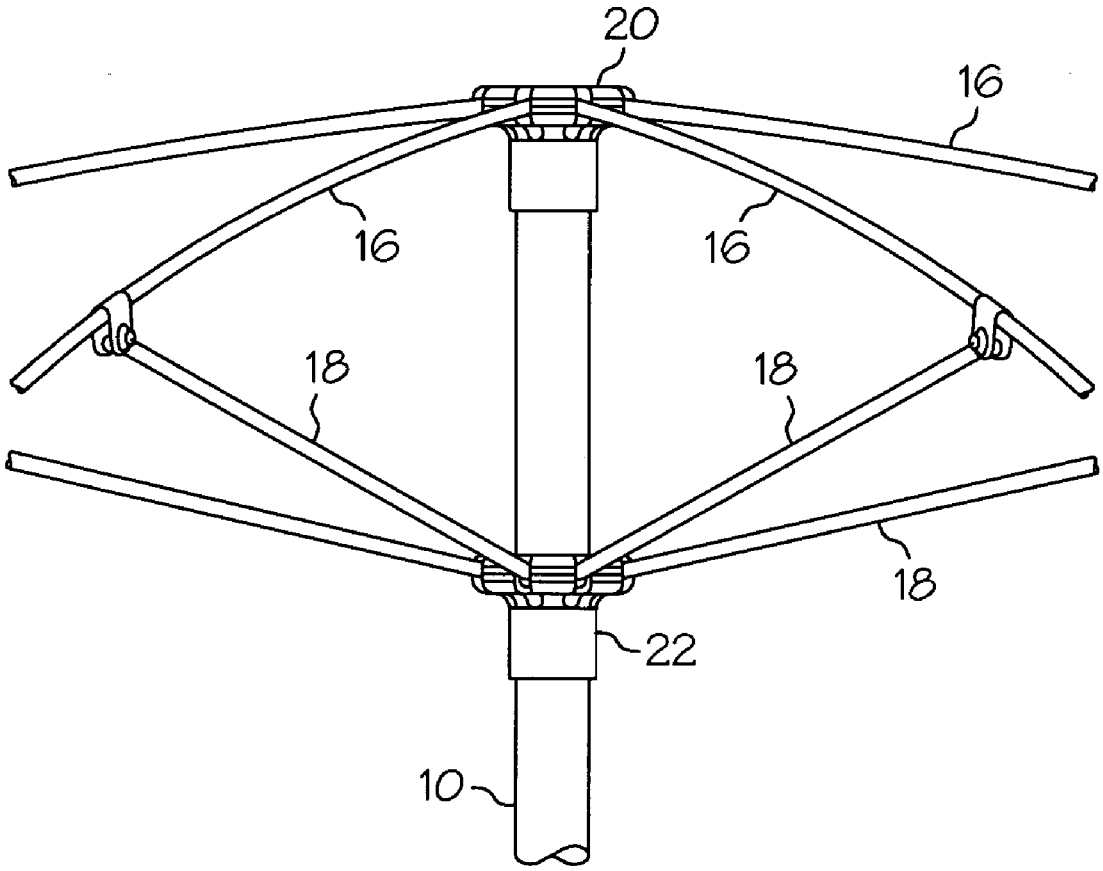
FIG. 2 is an enlarged partial side view of the same embodiment shown in FIG. 1.

FIG. 2 is a side view of the same embodiment shown in FIG. 1 showing the details of the ribs 16 and spreaders 18 and their relative attachments. The cover 14 (see FIG. 1) is removed for clarity. Each rib 16 is attached at a proximal end to a central rib hub 20. The rib hub 20 is rigidly secured to the ridge pole 10. The function of the rib hub 20 is to locationally retain the ribs 16 while providing pivotal movement of the ribs 16 about a horizontal axis through the proximal end of each rib 16. The details of the rib hub 20 and its operation are provided below.

Each spreader 18 is pivotally attached at its respective proximal end to a central spreader hub 22. The spreader hub 22 is slidably secured to the ridge pole 10 to allow relative vertical motion of the spreader hub—and the attached spreader ends. The function of the spreader hub 22 is to locate the spreader proximal ends adjacent the ridge pole 10 and provide for vertical movement of the proximal ends to effect the opening and closing of the umbrella. This basic function and operation is similar to that of prior art umbrella structures. The details of the spreader hub 22 and its operation are provided below.

Figure 3:
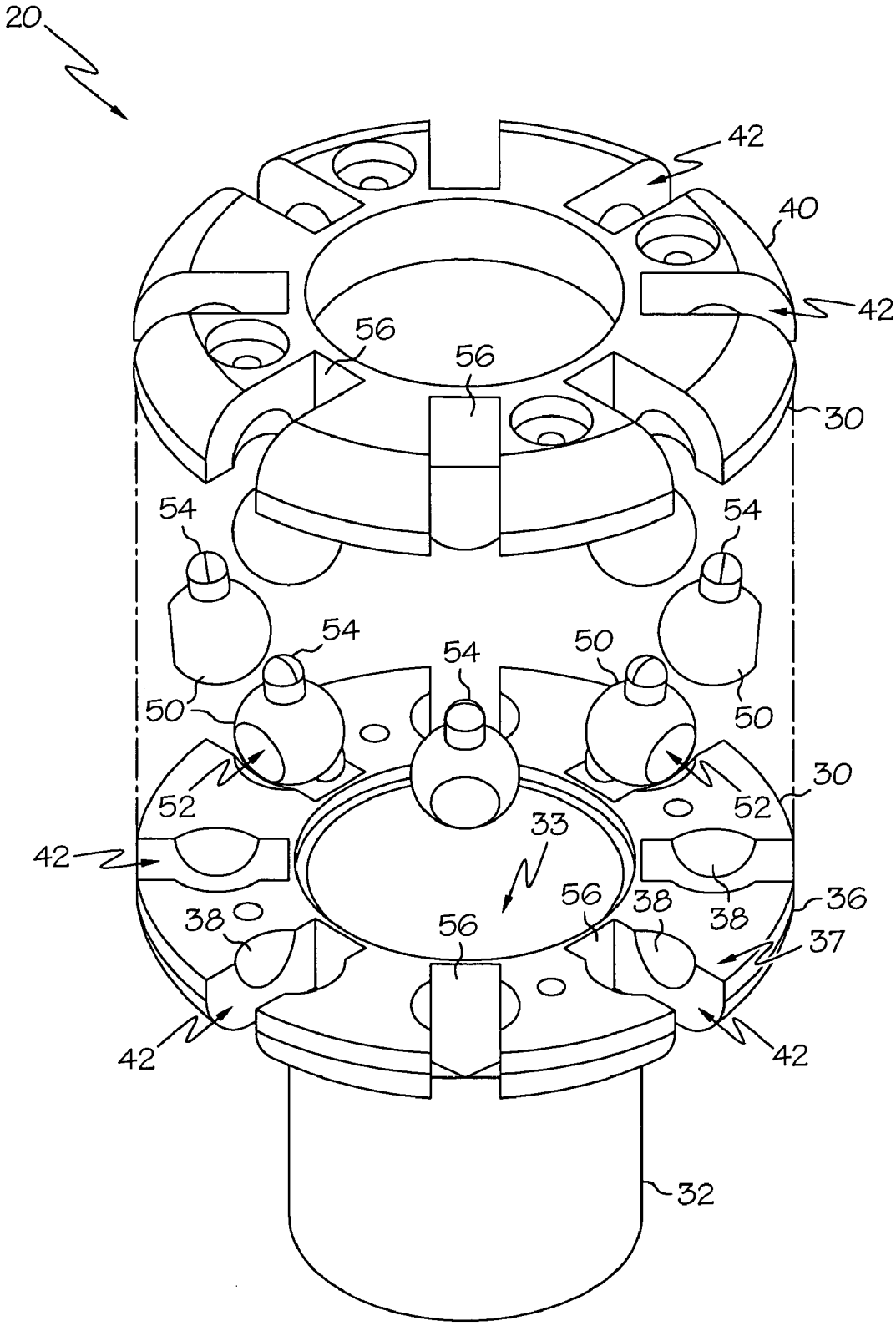
FIG. 3 is a perspective view of a preferred embodiment of the inventive umbrella hub including spherical joint knuckles for use as a rib hub.
Figure 4:
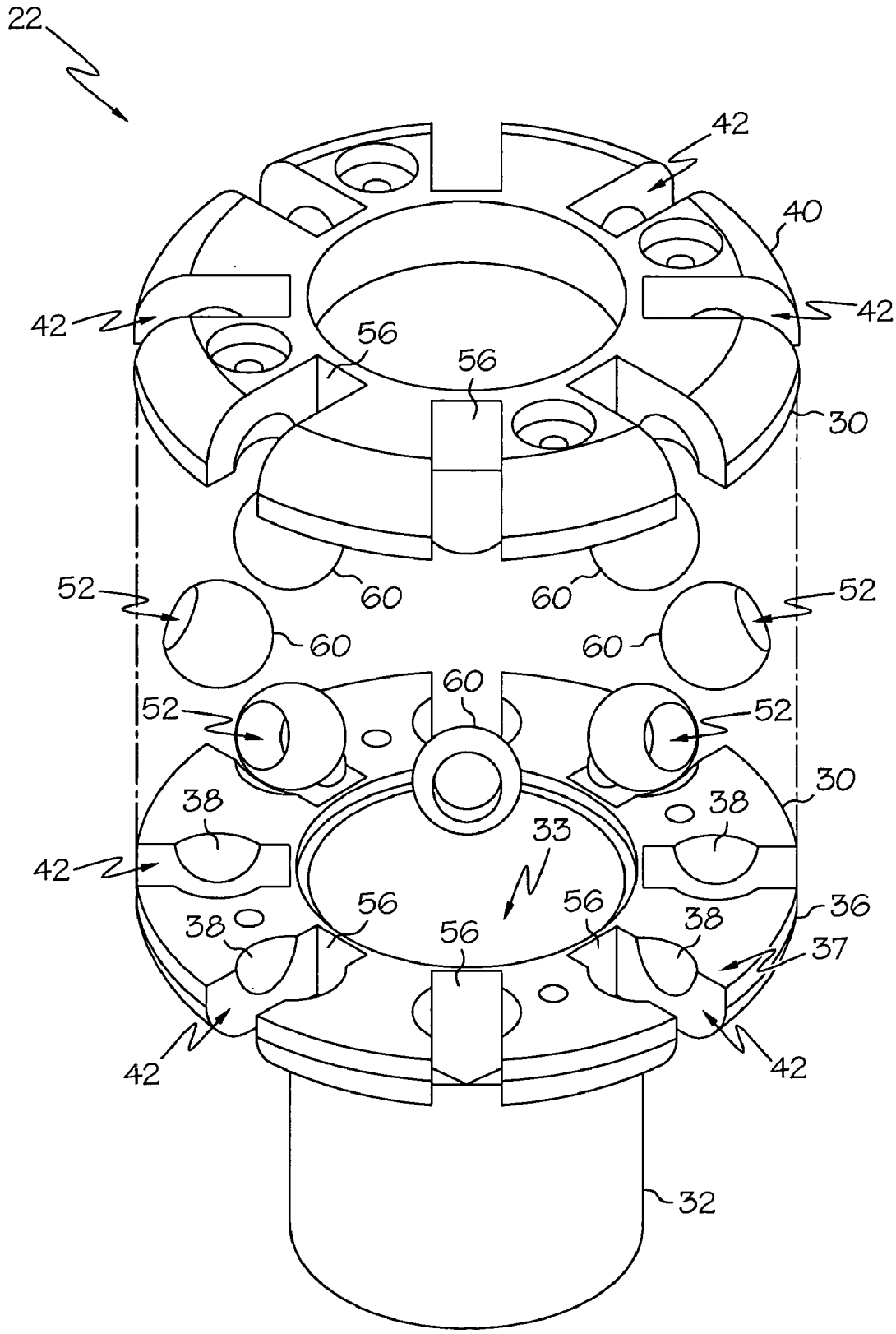
FIG. 4 is a perspective view of a preferred embodiment of the inventive hub including joint knuckles configured for use as a spreader hub.

FIGS. 3 and 4 are perspective views of a preferred embodiment of an inventive umbrella rib hub and spreader hub, respectively. To simplify and reduce cost, the rib and spreader hub bodies 30 are preferably identical. The following discussion pertains to both hubs of the preferred embodiment except where otherwise indicated. In other embodiments, the rib and spreader hub bodies may be dissimilar.

In FIGS. 3 and 4 the hub body 30 is shown exploded on opposite sides of joint knuckles 50, 60. Each hub body 30 includes a hub cylindrical sleeve 32 having a longitudinal cylindrical bore 33 with an internal diameter sized for slidable engagement with the round ridge pole 10. The sleeve 32 has a longitudinal length sufficient to provide stability against pivotal rocking of the spreader hub sleeve on the ridge pole. Preferably, the sleeve longitudinal length is at least equal to the internal diameter. The sleeve wall thickness is somewhat dependent on the material of construction and may be easily determined by the designer.

At the upper extent of the hub sleeve 32 a hub flange 36 extends radially outward from, and perpendicular to, the bore 33. The hub flange 36 has a circular perimeter, although this particular geometry is not critical. The hub flange 36 has a flat, upwardly directed, flange face 37 that is orthogonal to the bore centerline. Located evenly spaced in a circular pattern about the flange face 37 are a number of spherically shaped cavities or depressions 38. Herein, the depressions are described as spherical although they are not complete spheres. The term "spherical" includes partial and complete surfaces having spherical shape. In the embodiment shown, there are eight such depressions 38, although other numbers are also operable. The configuration and function of these depressions are discussed below.

The hub body 30 includes also a generally disk shaped flange face plate 40 that mates to the hub flange 36. The face plate 40 has a mating surface with half-sphere depressions 38 sized and configured to mate identically with those of the flange 36. Upon co-joining of the flange 36 and face plate 40 surfaces, the pairs of respective mating depressions 38 each form a spherical joint cavity. The face plate includes a continuation of the center bore 33. Slots 42 are cut, or formed, in both the flange 36 and face plate 40, from their perimeter, radially inward, and entirely through the center of each spherical depression 38. Each slot 42 extends slightly inward of the respective depressions. The width of each slot is narrower than each depression's diameter such that four depression portions are part of one spherical surface—two in each of the flange 36 and face plate 40.

The function of the depressions 38 is to form a retaining bearing surface for receiving a rib or spreader ball joint knuckle 50, 60. The rib hub 20 and spreader hub 22 have respectively differently configured knuckles and they both will be discussed in subsequent sections herein. However, the following discussion of the configuration of the knuckles 50, 60 and the flange depressions 38 apply to both except where otherwise indicated. Each knuckle 50,60 is a rigid element having a generally spherical outer surface and having a radius slightly less than the radius of the corresponding depressions receiving the knuckle. In this manner, when a knuckle 50, 60 is disposed within depressions 38 and the hub portions assembled, the ball joint knuckles 50,60 are free to rotate while being locationally retained to the respective hub 30. While the size of each knuckle is independent of the others, and each may be different, for obvious practical reasons, they are preferably of a common size and configuration. The depressions should be configured to retain the knuckles in a plane orthogonal to the sleeve bore 33 and hence also the ridge pole 10 long axis.

Each knuckle 50,60 includes an open receptacle 52 as a means of receiving and attaching a proximal end of a rib 16 or spreader 18. Preferably, each rib 16 and spreader 18 has a circular cross-section and hence each receptacle 52 is cylindrical in shape to securely attach the rib 16 or spreader 18. Other geometries are also contemplated, including square cross-section ribs 16 and spreaders 18 received in similar cross-section cavities. The center axis of the receptacle 52 passes through, and is centered on, the center of the knuckle 50,60 such that a received and attached rib 16 or spreader 18 rotates about the knuckle center when moved in the hub. Once received in a knuckle receptacle 52, a rib 16 or spreader 18 may be secured to the knuckle 50,60 by means of adhesive, rigid fasteners, or other means. Alternatively, each rib 16 or spreader 18 may have a respective integrally formed knuckle 50,60 at its distal end.

The function of the knuckles 50,60 and the associated depressions 38, is to provide enlarged rotation bearing surfaces connecting each rib 16 and spreader 18 to the hub 30. The enlarged surface reduces bearing stresses and friction which in turn increases durability and ease of operation. "Enlarged" is meant here to be in comparison to a bearing surface that might be provided by a through-shaft passing through a transverse hole in the proximal end of a prior art umbrella rib or spreader. In the present design, the enlarged bearing surface is a consequence of the larger radius of curvature of the knuckle and depression relative to the rib and spreader cross-section.

To further enhance the ease of use and durability of the device, the hub flange 36, face plate 40 and knuckles 50, 60 are preferably formed of a high density plastic, preferably by molding operations. The depressions 38 and cavities 52 may be molded or milled. The use of such plastics is additionally advantageous in typical use environments, such as sand beaches. The use of plastics—over metals—reduces galling and other degradations typical in use of metal components used in prior art devices. Other materials, such as non-corrosive metals, may also be used in the inventive device without the particular benefits of plastics discussed.

In operation, the ribs 16 and spreaders 18 rotate about their proximal ends at the hub body 30 to alternately elevate and lower the umbrella cover 14. To allow this movement when the ribs 16 and spreaders 18 are attached to the knuckles 50,60, the ribs 16 and spreaders 18 pass through the slots 42. For this reason, the width of the slots must be slightly greater that the width or diameter of the respective rib or spreader. The slots 42 serve the purpose of providing support to the proximal end of an associated rib 16 or spreader 18 with respect to preventing lateral movement and rotation about the respective vertical axis. These limitations are necessary for the preferred operation of the device.

The rib hub 20 and spreader hub 22 (FIG. 2) differ in the configuration of the particular knuckles received in the respective hub body depressions in assembly. As the spreaders 18 need no limitation on their vertical rotation on the anchoring knuckle, the spreader knuckles 60 may have a smooth outer surface without interruption. However, to provide bending of the ribs as is desired in some umbrellas, the rib proximal ends must be stopped in rotation at a common preset angle that is less than perpendicular to the ridge pole. To enable this function, each rib knuckle 50 has a stop post 54 extending from the exterior surface of the knuckle 50. The stop post 54 is preferably located 90 degrees from the centerline of the receptacle 52 and extends in a radial outward direction. The knuckle 50 is assembled into a hub with the stop post 54 positioned upward—into the faceplate 40. In operation, when the ribs 16 reach the desired top-most angle, the stop-posts 54 contact a terminal wall 56 of the hub slot 42 and this interference prevents further rotation of the knuckle 50. At this point, further elevation of the spreader hub 60 will force a bend in the ribs 16. This operation of forming a rib bend by force of the spreaders is generally known in the prior art although the present structure for, and method of, stopping the rib proximal end rotation is novel. The interference of the stop post 54 and the terminal wall 56 is dependent on at least the relative location of the terminal wall and the size and geometry of the stop post 54, and many different geometries are possible to provide the needed function for a particular umbrella design. Similarly, in the embodiment shown, the terminal wall 56 is vertical and includes portions in the flange 36 and the face plate 40. Other geometries are also contemplated to serve the same function.

To form an umbrella according to the invention, two identical hubs are provided as discussed above. One is assembled with spherical spreader knuckles 60 to form a spreader hub 22 and one is assembled with rib knuckles 50 to form a rib hub 20. The rib hub 20 is rigidly secured to the top of a ridge pole 10 by sliding the end of the ridge pole 10 into the sleeve bore 33 and permanently attaching it there. The spreader hub 22 is slid over the lower end of the ridge pole and positioned near the rib hub 20. The ridge pole 10 should include a means of releasably fixing the spreader hub 22 in an open umbrella position. Ribs 16 and spreaders 18 are attached by securing them to respective hub knuckles 50, 60. The rib hub 20 and spreader hub 22 are rotationally oriented on the ridge pole with pairs ribs 16 and spreaders 18 co-aligned vertically to allow them to be properly connected and operated. A cover 14 is secured to the ribs. The above may occur in various sequences to arrive at the same finished configuration.

To enable the spreaders 18 to operate as desired, their distal ends are each pivotally secured to a respective rib 16 as shown in FIG. 2. This is preferably accomplished using a pivot joint formed of a spherical knuckle configured and retained in the manner discussed above in a clamshell type joint structure removably attached to the rib 16.

The hub flange 36 and face plate 40 may be secured together in any of a variety of means. In the embodiment shown, fastener lead holes and counterbores are provided for threaded fasteners which may be easily removed for future maintenance of the hub or replacement of parts such as bent ribs or spreaders. In other embodiments, securing means, both removable and permanent may be used, including rivets, adhesives, and plastic or metallic welding and others. Although the hub flange 36 and face plate 40 are shown in the figures with a planar parting line and faces, it will be obvious that the mating face surfaces may have other geometries while still providing the essential function allowing entry by, and removal of, the knuckles from the flange depressions. The face plate 40 have also be formed of multiple parts, each including a portion of the spherical bearing surface as a removable depression portion.

In alternative embodiments, both the ridge pole 10 and hub sleeve bore 33 have cross-section geometries other than circular, such as square. These allow the same operation as discussed above. However, for many reasons that will be obvious, a circular cross-section is preferred.

In alternative embodiments, the rib hub 20 does not include a hub sleeve 32, but is directly fixed to, or integral to, the ridge pole 10. The inclusion and use of the hub sleeve 32 with the rib hub 20 is a matter of convenient preference due to the use of the sleeve 32 with the spreader hub 22 and desire to manufacture a single, multi-use part.

Herein, the words, "up", "down", "vertical", and "horizontal" and similar terms are intended to be interpreted as relative to the figures and embodiments discussed and the associated cooperating elements of the invention and are not intended to be otherwise limiting.

The preceding embodiments and discussions are provided for example only. Other variations of the claimed inventive concepts will be obvious to those skilled in the art. Adaptation or incorporation of known alternative devices and materials, present and future is also contemplated. The intended scope of the invention is defined by the following claims.

I claim:

1. An umbrella comprising:

an elongated ridge pole having a top and bottom end;

a rib hub fixed to the top end and a spreader hub slidably engaged to the ridge pole between the top and bottom end;

the rib hub and spreader hub each comprising:

a plurality of spherical joint knuckles, each having an open receptacle;

a flange and a face plate having respective mating faces, both faces having spherically shaped depressions; the flange and face plate co-joined such that the depressions of each face mate with respective depressions on the other face and rotatably retain therein the joint knuckles;

the flange and face plate each further having an outer perimeter and a plurality of slots, each slot extending radially inward from the perimeter to an associated knuckle;

a plurality of elongated ribs, each having an end, the rib end secured within a respective rib hub knuckle receptacle, each rib extending outward through the associated slot;

a plurality of elongated spreaders, each having a first and second spreader end, the first spreader end secured within a respective spreader hub knuckle receptacle, each spreader extending outward through the associated slot, the second end of each spreader pivotably secured to a respective rib; and a flexible cover attached to the ribs.

2. An umbrella, according to claim 1, and wherein:

each spreader knuckle has a stop post extending outward from a knuckle exterior surface;

the stop post contacting the face plate to limit rotation of the knuckle in an umbrella open condition wherein the ribs are extending radially outward from the rib hub.

3. An umbrella, according to claim 1, and wherein:

the spreader hub further comprises a cylindrical sleeve having a cylindrical bore, the ridge pole slidably disposed in the bore; and the flange extending radially out from the sleeve.

4. An umbrella, according to claim 3, and wherein:

the rib hub further comprises a cylindrical sleeve having a cylindrical bore, the ridge pole fixed in the rib hub bore; and the rib hub flange extending radially out from the rib hub sleeve.

5. An umbrella comprising:

an elongated ridge pole having a top and bottom end;

a rib hub fixed to the top end and a spreader hub slidably engaged to the ridge pole between the top and bottom end;

the rib hub and spreader hub each comprising:

a sleeve having a longitudinal bore;

a flange extending radially outward from the sleeve;

a face plate;

the flange and face plate having respective mating faces, both faces having a plurality of spherically shaped depressions, the flange and face plate co-joined such that each depression of the flange mates with associated depressions on the face plate;

the flange and face plate both further having a plurality of slots, each slot extending radially outward, with respect to the sleeve bore, from a respective depression to a flange perimeter;

a plurality of elongated ribs, each having a rib first end having a spherical knuckle, each knuckle disposed between the rib hub flange and face plate and rotatably retained by the depressions, and each rib extending outward through a rib hub slot;

a plurality of elongated spreaders, each having a spreader first and second end, the first spreader end having a spherical knuckle, each knuckle disposed between the spreader hub flange and face plate and rotatably retained by the depressions, and each spreader extending outward through a spreader hub slot, the second end of each spreader pivotably secured to a rib; and a flexible cover attached to the ribs.

6. An umbrella, according to claim 5, and wherein:

the face plate is removable from the flange such as to enable removal of each knuckle.

7. An umbrella, according to claim 6, and wherein:

the bore has a cylindrical cross-section.

8. An umbrella, according to claim 7, and wherein:

each rib knuckle has a stop post extending outward from a knuckle exterior surface, the stop post contacting the face plate thereby limiting rotation of the knuckle in an umbrella open condition wherein the ribs are extending radially outward from the rib hub.

9. An umbrella hub providing for central attachment of umbrella ribs, and alternatively, central attachment of umbrella spreader elements, the hub comprising:

a cylindrical sleeve having a longitudinal bore;

a plurality of spherical joint knuckles, each joint knuckle including a stop post extending outward from a knuckle exterior surface;

a hub flange secured to the sleeve and having a plurality of spherical bearing surfaces located in an evenly spaced circular configuration in a plane orthogonal to the bore, the knuckles each rotatably retained within a respective bearing surface and limited in rotation by the stop post.

10. The umbrella hub according to claim 9 and wherein:

the flange comprises two separable portions each having a respective mating face and both faces having spherically shaped depressions, the flange and face plate joined such that the combined depressions define the bearing surfaces; the flange further having an outer perimeter and a slot associated with each knuckle, each slot extending radially inward with respect to a flange centerline, from the perimeters to the associated knuckle.

* * * * *